United States Patent [19]

Sukenik

[11] Patent Number: 4,542,566

[45] Date of Patent: Sep. 24, 1985

[54] CORRUGATING ROLLER

[75] Inventor: Robert J. Sukenik, Bloomfield Hills, Mich.

[73] Assignee: Corrugating Roll Corporation, West Bloomfield, Mich.

[21] Appl. No.: 441,921

[22] Filed: Nov. 15, 1982

[51] Int. Cl.[4] ..... B30B 11/18

[52] U.S. Cl. ..... 29/125; 29/123; 29/124; 29/121.1

[58] Field of Search ..... 29/125, 124, 123, 121.5, 29/116 R, 121.6; 100/93 RP; 15/181

[56] References Cited

U.S. PATENT DOCUMENTS

| | | | |
|---|---|---|---|
| Re. 28,581 | 10/1975 | Koch . | |
| 50,802 | 11/1865 | Danner . | |
| 287,711 | 10/1883 | Ortman . | |
| 393,518 | 11/1888 | Redington . | |
| 588,261 | 8/1897 | Binckley . | |
| 767,268 | 8/1904 | Felsing, Jr. . | |
| 826,129 | 7/1906 | Troup . | |
| 1,023,856 | 4/1912 | Langer . | |
| 1,028,909 | 6/1912 | Say . | |
| 1,061,770 | 5/1913 | Miller . | |
| 1,085,420 | 1/1914 | Hess . | |
| 1,142,661 | 6/1915 | Biela . | |
| 1,159,716 | 11/1915 | Schmidt . | |
| 1,264,506 | 4/1918 | Hahn . | |
| 1,283,123 | 10/1918 | Erkelens . | |
| 1,297,773 | 3/1919 | Adams . | |
| 1,308,160 | 7/1919 | Brinton . | |
| 1,390,693 | 9/1921 | Fernandez . | |
| 1,428,142 | 9/1922 | Canda . | |
| 1,506,133 | 8/1924 | Peterson . | |
| 1,533,933 | 4/1925 | Lusher . | |
| 1,558,206 | 10/1925 | Simpson . | |
| 1,587,963 | 6/1926 | Knopf . | |
| 1,723,078 | 8/1929 | Richards . | |
| 1,775,277 | 9/1930 | Gahn . | |
| 1,892,812 | 1/1933 | Rous . | |
| 1,924,827 | 8/1933 | Anderson . | |
| 1,954,635 | 4/1934 | Leonard, Jr. . | |
| 1,962,148 | 6/1934 | Johnson | 29/123 X |
| 2,163,063 | 6/1939 | Romanoff . | |
| 2,219,077 | 10/1940 | Pharo . | |
| 2,258,443 | 10/1941 | Bruker . | |
| 2,341,335 | 2/1944 | Simmons . | |
| 2,352,194 | 6/1944 | Grabec . | |
| 2,378,643 | 6/1945 | Losey | 29/125 X |
| 2,429,482 | 10/1947 | Munters . | |
| 2,455,980 | 12/1948 | Dallas et al. . | |
| 2,596,554 | 5/1952 | Hoff . | |
| 2,658,262 | 11/1953 | Clements . | |
| 2,783,719 | 3/1957 | Rhodes . | |
| 2,803,040 | 8/1957 | Robert et al. . | |
| 2,880,599 | 4/1959 | Hlinsky . | |
| 2,939,331 | 6/1960 | Weeks . | |

(List continued on next page.)

*Primary Examiner*—Mark Rosenbaum
*Assistant Examiner*—John T. Burtch
*Attorney, Agent, or Firm*—Harness, Dickey & Pierce

[57] ABSTRACT

A forming roller for corrugating sheet material or for performing other forming operations includes a number of relatively thin discrete forming discs coaxially mounted in compression for rotation with a rotatable mandrel. The forming discs preferably have undulating flutes on their peripheral surfaces to form the roller's forming surface. The forming discs may optionally include irregular openings extending therethrough in an irregular pattern to vary the resonant frequency, thereby reducing the operating noise of the roller. The openings may also be filled with a sound-absorbing material. The roller may also be equipped with means for heating the forming roller sheet material, vacuum means for retaining the sheet material against the roller surface, and sound-absorbing spacer discs between adjacent forming discs.

43 Claims, 10 Drawing Figures

U.S. PATENT DOCUMENTS 3,008,220 11/1961 Sammarco ..... 29/148.4
3,069,922 12/1962 Harvey .
3,090,105 5/1963 Gibbar et al. .
3,225,616 12/1965 Whitehead .
3,238,866 3/1966 Strindlund ..... 100/99
3,289,631 12/1966 Vachon et al. .
3,351,001 11/1967 Achkio .
3,503,241 3/1970 Vom Dorp et al. .
3,516,889 6/1970 Boynton et al. .
3,541,656 11/1970 Devon .
3,671,361 6/1972 Morrison .
3,742,779 7/1973 Shaver .
3,742,852 7/1973 Lefflev et al. ..... 29/125 X
3,791,481 2/1974 Yazaki .
3,830,612 8/1974 Komarek .
3,857,296 12/1974 Tsunoda .
3,919,029 11/1975 Osgood .
3,947,206 3/1976 DeLigt et al. .
3,982,312 9/1976 Finzer .
4,008,598 2/1977 Purcupile et al. .
4,031,769 6/1977 Kassing .
4,099,811 7/1978 Kark .
4,245,975 1/1981 Hattori ..... 425/363
4,245,975 1/1981 Hattori .
4,261,692 4/1981 Kuby .
4,269,055 5/1981 Sivachenko et al. .
4,385,683 5/1983 Krupp ..... 29/116 R X

CORRUGATING ROLLER

BACKGROUND AND SUMMARY OF THE INVENTION

The invention relates generally to roll-forming apparatus, and more particularly to corrugating rollers for producing corrugated sheet material.

Typically, corrugating operations are performed by passing sheet material, commonly referred to as the "medium" in the corrugated paper industry, through the nip point of a pair of large rollers having undulating flutes. Such rollers are typically mounted for rotation in corrugating apparatus commonly referred to as a "single facer". The corrugating surfaces of such rollers are usually hardened for increased wear resistance by various processes known to those skilled in the art. In the hardening process, care must be taken to avoid overly hardening the shaft portion of the roller, thereby making it too brittle.

It is frequently desirable to heat at least one of the rollers by passing steam through an internal chamber in order to facilitate the forming of the medium. Additionally, one of the pair of such rollers may also include axially-spaced circumferential slots for receiving a semicircular finger partially circumscribing on the opposite roller in order to maintain the formed medium in contact with such opposite roller. Alternatively, so-called "fingerless" single facers employ a vacuum system for retaining the medium in place.

One problem typically encountered in such corrugating apparatus is the noise level generated by the high-frequency impacts of the tips and valleys of the rollers. This noise level, amplified by the further resonance throughout the rollers, may exceed permissible levels, thereby necessitating ear protection for personnel working the area. Another problem is that a foreign object, such as a bolt or nut, passing through the nip point of the rollers may bend, break, or otherwise damage one or more of the flutes, thereby ruining a very expensive set of corrugating rollers. Still another problem related to the manufacture of forming rollers is that any error in manufacturing the roller surface may necessitate the scrapping of the entire roller, which is extremely costly.

According to the present invention, a forming or corrugating roller includes a plurality of forming discs coaxially mounted on an elongated cylindrical mandrel. The axial thickness of each disc is preferably thin relative to its diameter in order to provide a substantial number of abutting faces which tend to reduce the noise by frictional damping. The circumferential surfaces of the discs have undulating flutes that form the corrugating surface. Since the discs are not an integral part of the mandrel, they may be formed and hardened before being mounted on the mandrel. Furthermore, in the event of an error in the manufacture of the functional surface, or an accidental damaging of the flutes, only the affected discs are scrapped instead of the entire roller.

The forming discs, which are secured for rotation with the mandrel, may optionally include irregularly-shaped axially-extending openings located in an irregular pattern to provide a varying resonant frequency, thereby reducing noise caused by the contact of the flutes on the rollers. The mandrel may also include a sound-absorbing material thereon, and sound-absorbing spacers may be inserted between adjacent discs. In order to provide the required rigidity, strength, sound absorption, and reliability of the roller assembly, each disc is secured to its adjacent discs preferably by relatively short axially-extending fasteners. Finally, the discs may also optionally include aligned openings extending axially therethrough for vacuum retention of the material to be formed in a fingerless forming machine configuration, or alternatively, channels or other fluid conduits communicating with an internal vacuum chamber in the mandrel for the same purpose. If vacuum retention is accomplished by such axial openings through the discs, the mandrel may include internal heating means.

Additional advantages and features of the present invention will become apparent from the subsequent description and the appended claims taken in conjunction with the accompanying drawings.

DETAILED DESCRIPTION OF THE PREFERRED EMBODIMENTS

Figure 1:
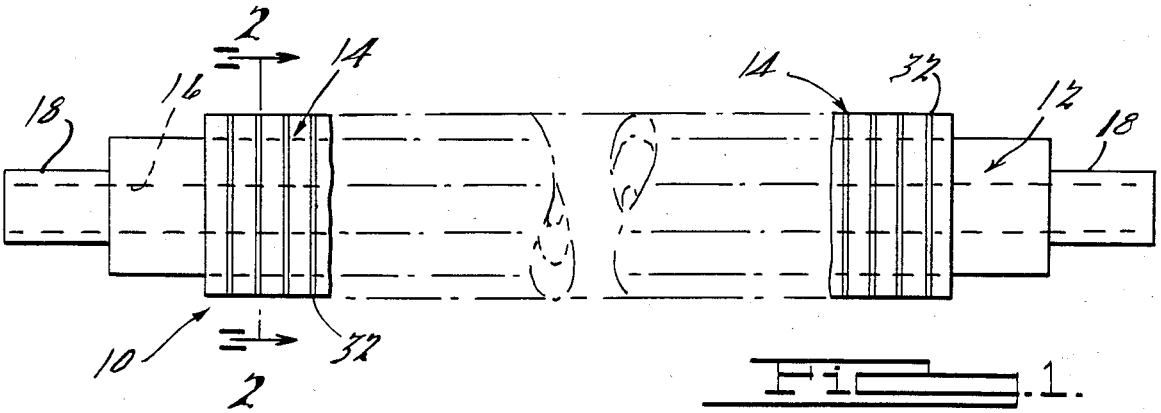
FIG. 1 is an overall longitudinal elevational view of a corrugating roller embodying the present invention.

FIGS. 1 through 9 of the drawings depict exemplary embodiments of a corrugating roller according to the present invention for purposes of illustration only. One skilled in the art will readily recognize from the following discussion that the principles of the invention are equally applicable to roll-forming apparatus other than corrugating rollers, and that such principles are also equally applicable to corrugating rollers other than those shown in the drawings.

Figure 2:
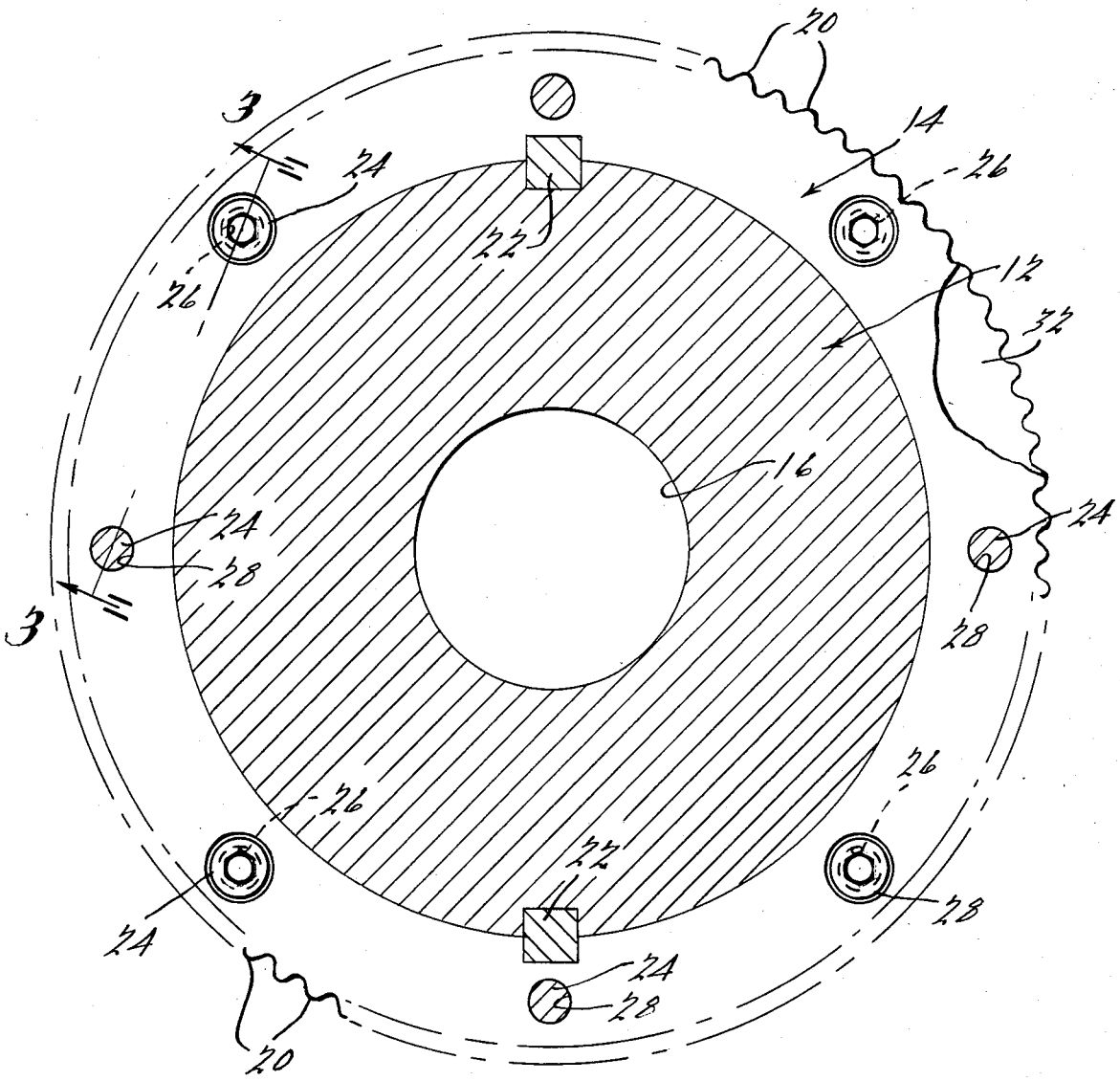
FIG. 2 is a cross-sectional view, partially broken away, taken along line 2—2 of FIG. 1.

As shown in FIGS. 1 and 2, an exemplary forming roller 10 generally includes a mandrel 12, a plurality of cooperating but discrete forming discs 14 thereon and a journal portion 18 at each end. The outer circumferential surfaces of the forming discs cooperate to form an outer forming surface on the roller 10 for forming sheet material passing between the nip point of a pair of such rollers disposed parallel to one another in a cooperating relationship.

The forming discs are thin in their axial dimensions relative to their diameters so that a substantial number of face-to-face joints are formed in order to provide for frictional damping between the discs for purposes of reducing noise. For purposes of example, the thickness of the forming discs may range from approximately 1/16 inch to approximately 1½ inch for an outside diameter of approximately 8 to 15 inches.

The forming discs 14 may be shrink-fitted on the mandrel 12, or secured thereto by means of an adhesive means, for example, and are further restrained from relative rotation on the mandrel 12 by key or keys 22. Each forming disc 14 includes a number of circumferentially-undulating flutes 20 disposed about its peripheral surface, with the flutes being aligned from disc to disc to form a fluted forming surface on the mandrel. The outside diameter of forming discs 14 may optionally be varied to be largest generally at the longitudinal middle of the roller in order to form a crowned forming surface, if desired. A duct 16 preferably extends axially through mandrel 12 for purposes of conveying heating steam or other fluids to heat the roller and the material to be formed, thereby facilitating the forming thereof.

Figure 2A:
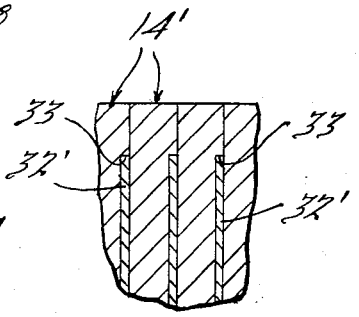
FIG. 2A is a partial cross-sectional view, taken along a diameter of the forming discs and showing an alternate configuration of the discs having sound-deadening material in a recess in one of the discs.

Although forming discs 14 may be mounted on mandrel 12 in a flush-mounted, face-to-face relationship with each other, a thin sound-adsorbing spacer disc 32 may optionally be mounted on the mandrel and disposed between each pair of adjacent forming discs 14, as shown in FIGS. 1 and 2. Alternatively, as shown in FIG. 2A, the spacer discs 32' may be smaller in diameter than the forming discs 14' and be contained within recessed portions 33 of the faces of one or both of adjacent forming discs 14'. Spacer discs 32 or 32' are composed of a different material than that of forming discs 14 or 14' for purposes of dampening and absorbing noise, and typically may have a compressed thickness of approximately 0.002 inch to approximately 0.50 inch, for example. Examples of some materials believed to be suitable for the sound-deadening spacer discs 32 or 32' include aluminum, brass, lead, or other relatively soft metals, as well as any of a number of plastic or composition materials known by those skilled in the art to possess sound-deadening characteristics. Furthermore, mandrel 12 may optionally have a sound-deadening material on its outer surface.

Figure 3:
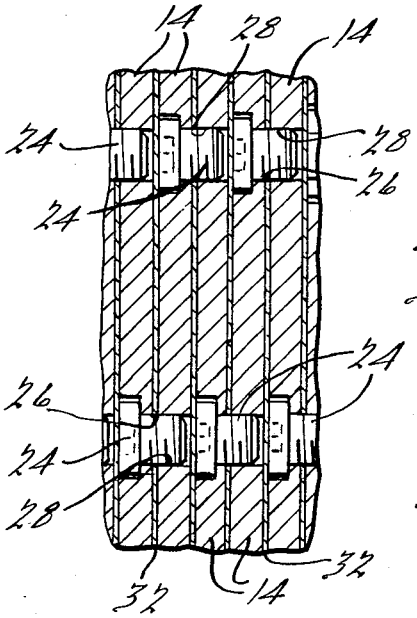
FIG. 3 is a partial cross-sectional view taken along line 3—3 of FIG. 2, showing the interconnection between adjacent forming discs.

As shown in FIGS. 2 and 3, forming discs 14 are axially secured to each other in compression preferably by a number of fasteners 24, which extend through apertures 26 at spaced circumferential positions on each forming disc (or group of forming discs) and which threadably engage threaded apertures 28 or other fastener retainer means in an adjacent forming disc (or group of forming discs). In order to allow the forming discs to be flush-mounted, the ends of fasteners 24, and the fastener retainers, if used, are countersunk or otherwise recessed into the corresponding faces of their associated forming discs.

Figure 4:
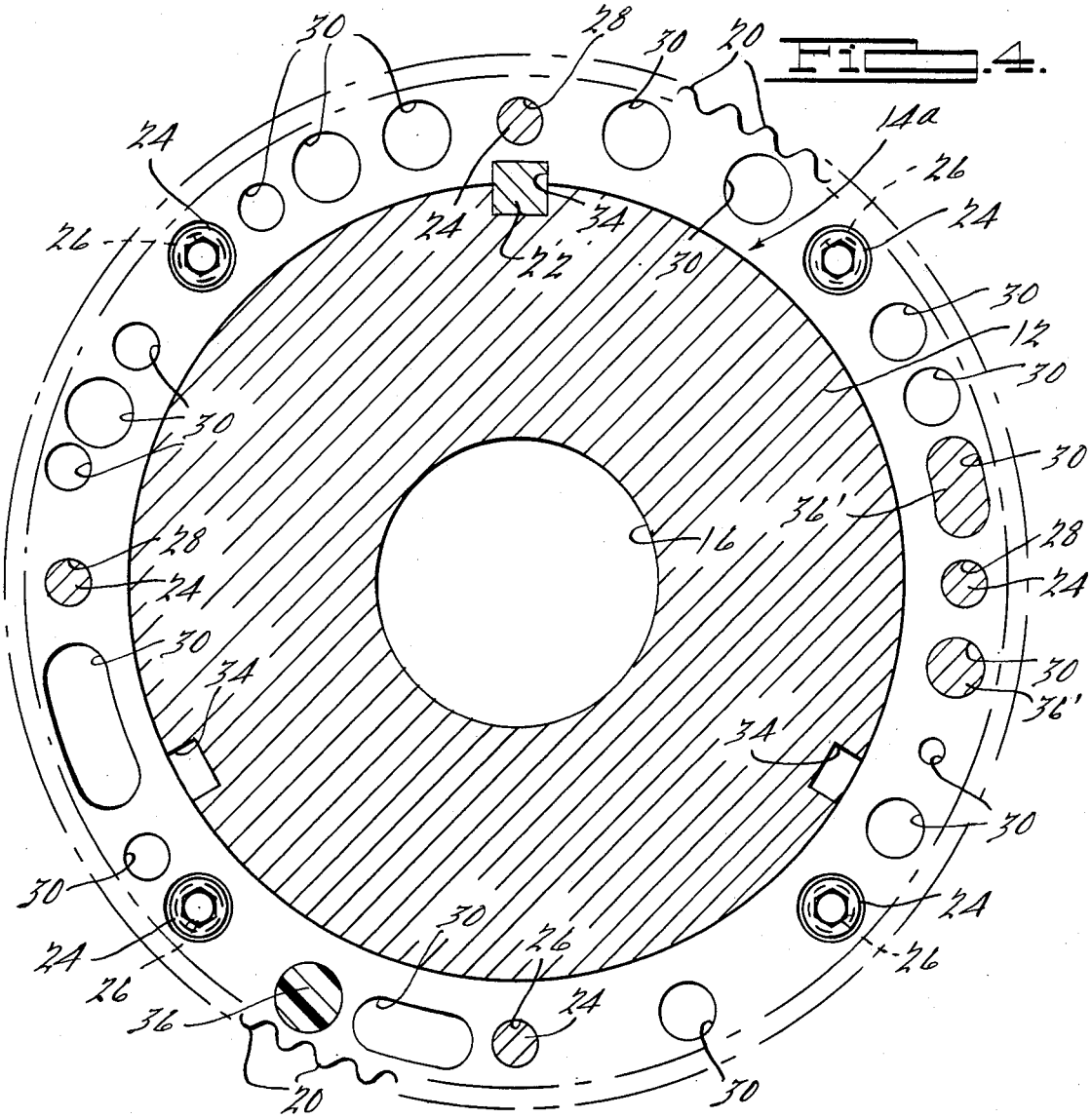
FIG. 4 is a view similar to that of FIG. 2, showing a forming disc having optional openings extending axially therethrough for accommodating sound-reducing material therein.

A forming disc **14*a* is shown in FIG. 4 and includes optional axially-extending openings 30 of varying irregular shapes and sizes, which may be located in an irregular pattern at various circumferential positions on the forming disc. The purpose of the irregular openings 30 is to vary the structural resonant frequency, thereby reducing roller noise during the forming operation. The addition of one or more keyways 34 at a number of different angular positions allows the forming discs to be assembled on the mandrel 12 in varying angular orientations in order to further reduce the overall resonance of the roller. The angular positions of such keyways 34 are located such that when the discs are assembled on the mandrel their flutes are aligned from disc to disc. Any or all of the openings 30 may be irregularly-shaped and filled with a sound-absorbing material such as the synthetic material 36 or a soft metal material 36', shown for example in FIG. 4. Spacer discs 32, which also are composed of sound-absorbing material, may be inserted between adjacent forming discs 14*a*, as shown in FIG. 2**, to further reduce operating noise.

Figure 5:
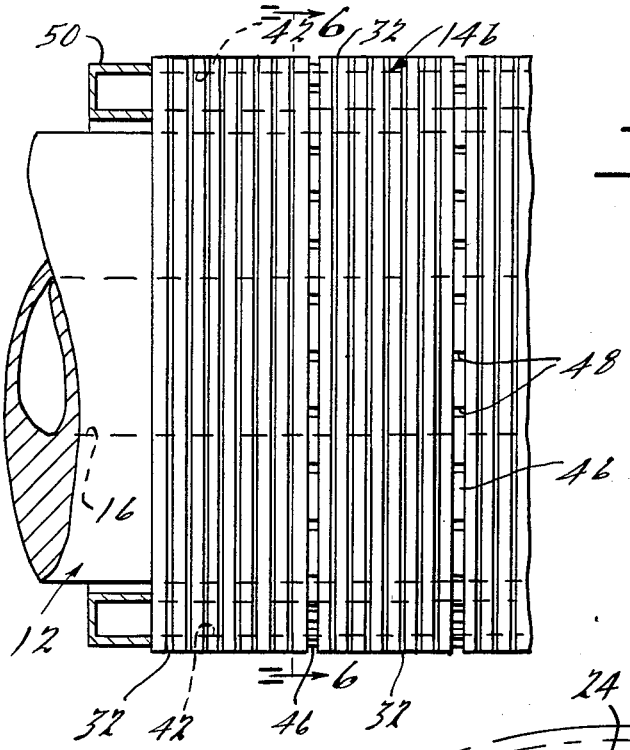
FIG. 5 is an enlarged partial longitudinal view of a corrugating roller, including an end manifold-type vacuum system and a steam heating system.
Figure 6:
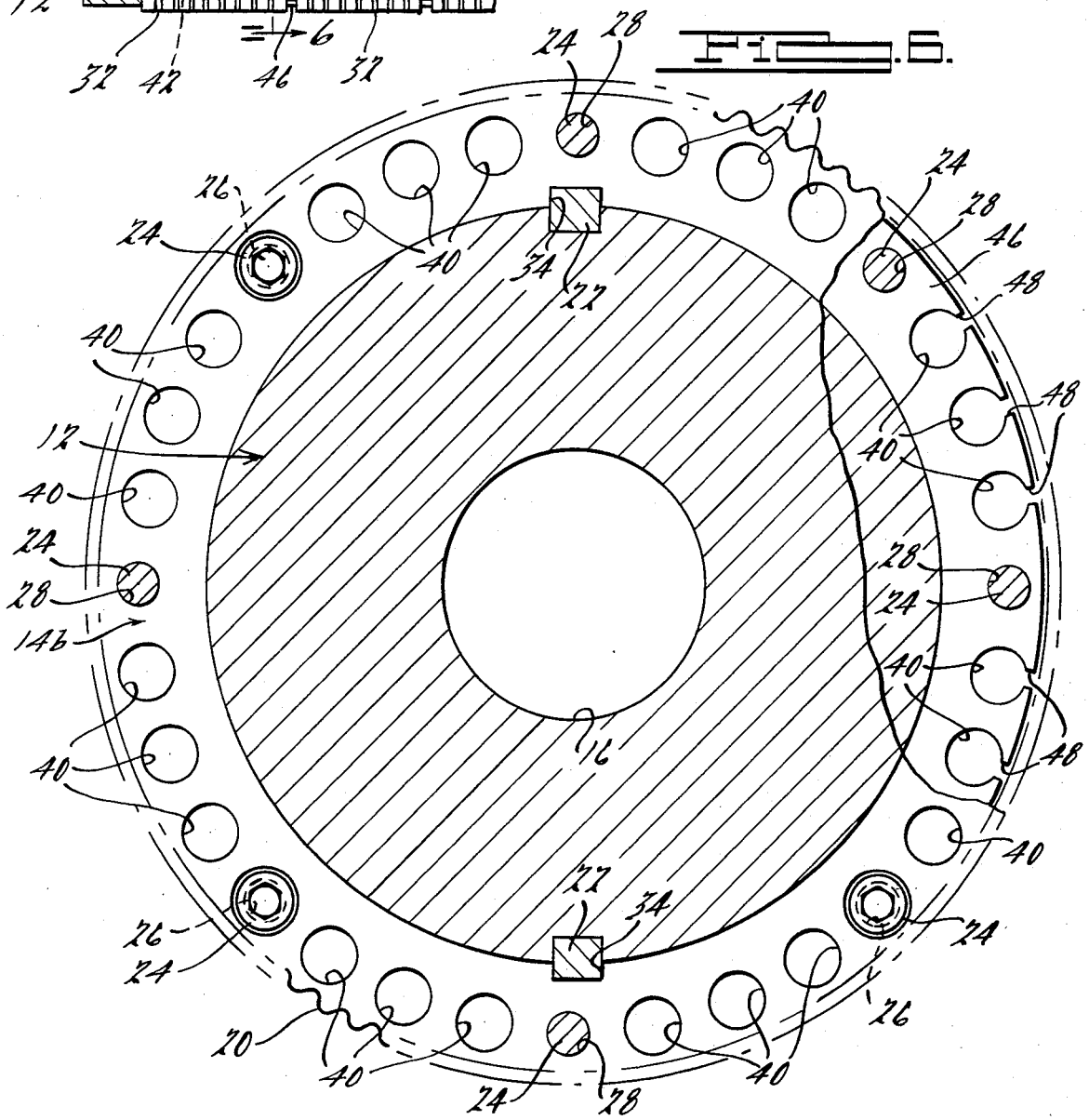
FIG. 6 is a cross-sectional view, partially broken-away, taken along line 6—6 of FIG. 5.

FIGS. 5 and 6 illustrate still another optional feature of the invention wherein each forming disc **14*b* includes a number of vacuum openings 40 extending therethrough. The openings 40 are aligned from disc to disc to provide a vacuum conduit 42 extending axially through the roller 10. A number of intermediate discs 46, are longitudinally spaced along the roller and have radially-extending passages 48 for placing the surface of the roller in fluid communication with the vacuum conduits 42. Optionally, intermediate discs 46 may be of the same sound-absorbing material as the spacer discs 32. A stationary vacuum manifold means 50 sealingly and slidably engages an end disc of the rotatable forming roller and communicates with the conduit 42 to impose a vacuum upon the roller in order to substantially retain the material to be formed (not shown) flush with the roller surface during forming. A forming roller having a vacuum retention feature is referred to as a "fingerless roller", and the vacuum retention embodiment shown in FIGS. 5 and 6 may also optionally include the above-discussed heating feature with duct 16 extending through mandrel 12. Furthermore, it should be noted that if the vacuum retention system is not desired an axially-extending conduit similar to conduit 42** may optionally be formed in the roller and filled with a sound-deadening material.

Figure 7:
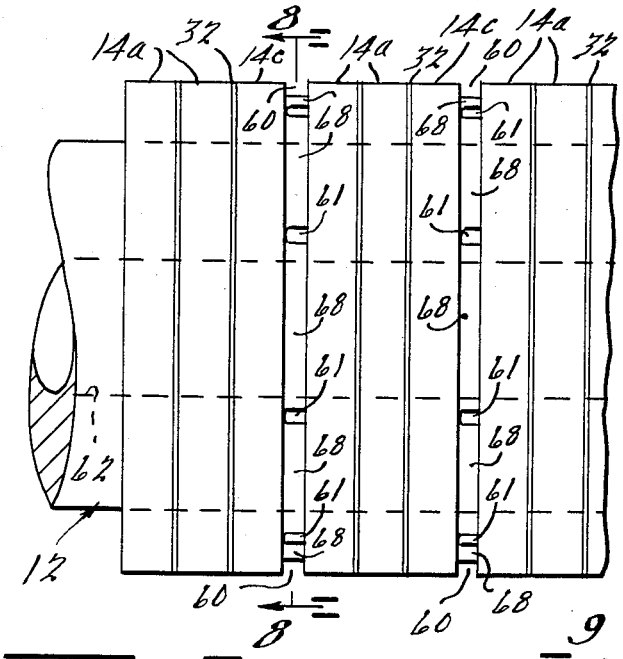
FIG. 7 is an enlarged partial longitudinal view of a corrugating roller, including an internal-type vacuum system.
Figure 9:
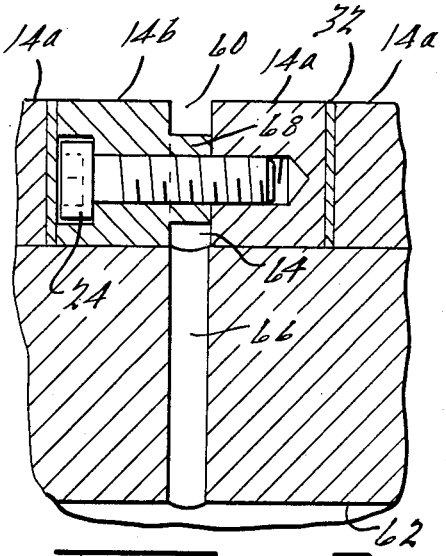
FIG. 9 is a cross-sectional view taken along line 9—9 of FIG. 8.
Figure 8:
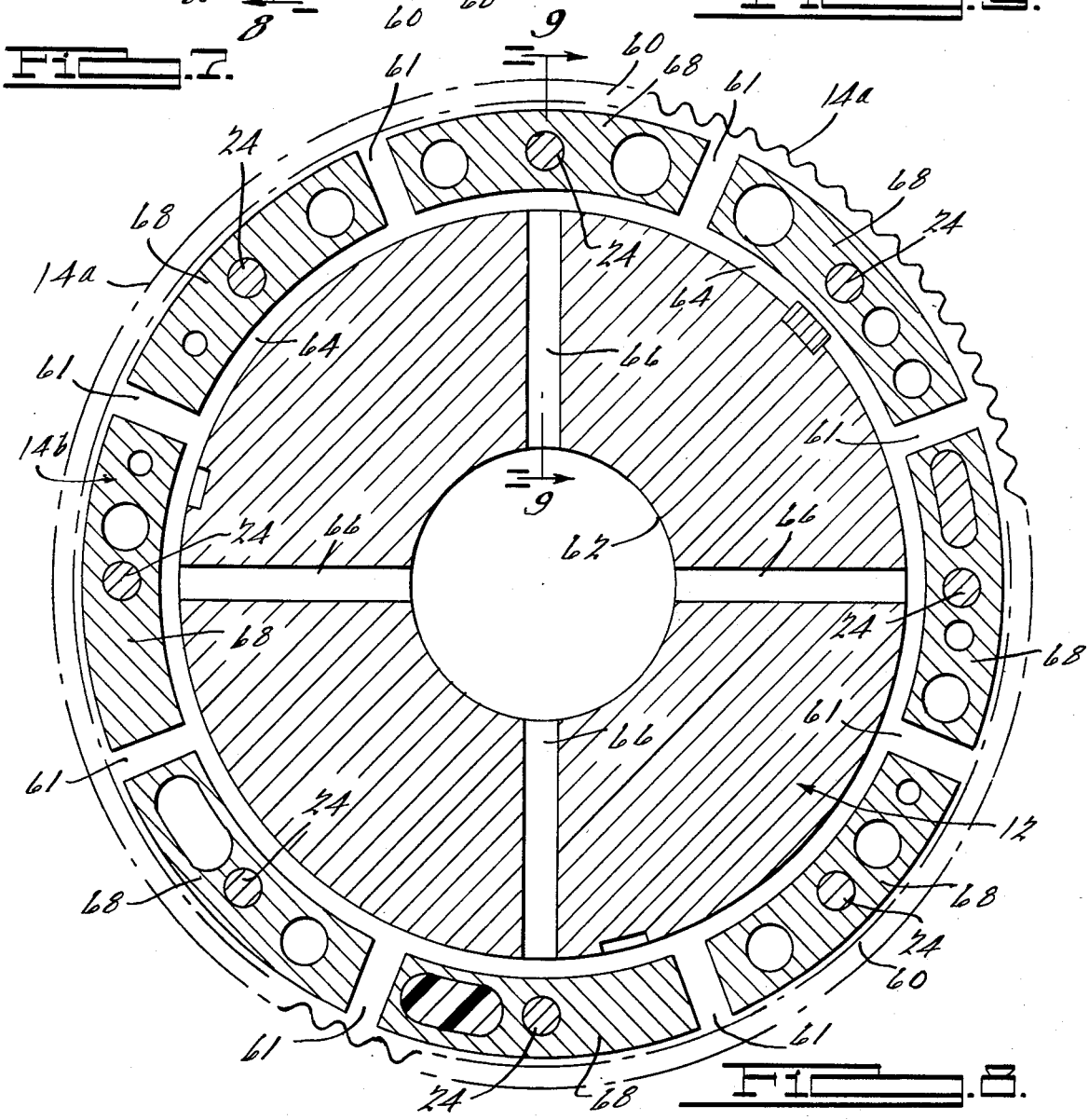
FIG. 8 is a cross-sectional view taken along line 8—8 of FIG. 7.

FIGS. 7 through 9 illustrate an alternate form of vacuum retention system. In this configuration, a forming disc **14*c* is included among forming discs 14*b* at axially-spaced intervals along the roller. Disc 14*b* includes a vacuum slot 60, which communicates with an internal vacuum chamber 62 extending through the mandrel. Such communication may be provided by way of a number of radial passageways or conduits 61, an intermediate manifold or passageway 64, and a number of mandrel passageways 66, or by way of the radial conduits 61 being directly aligned with the mandrel passageways 66**.

The slot 60, the radial conduits 61, and the intermediate manifold 64 are formed by a number of integral shoulders 68 protruding from discs **14*c*, as shown in FIGS. 7 through 9. Alternatively, a washer or other separate spacer (not shown) of any type known in the art, may be provided on the appropriate fasteners 24 between selected discs 14 at axially-spaced intervals to form the slots 60 and the radial conduits 61**.

The foregoing discussion discloses and describes merely exemplary embodiments of the present invention. One skilled in the art will readily recognize from such discussion that various changes, modifications, and variations may be made therein without departing from the spirit and scope of the invention as defined in the following claims.

What is claimed is:

1. A forming roller for a corrugating machine, comprising:

a rotatable mandrel;

a plurality of discrete forming discs coaxially mounted on said mandrel for rotation therewith, said forming discs cooperating to define a forming surface on said mandrel; and means for compressingly and rigidly securing each of said forming discs to one another on said mandrel, said securing means including a number of fasteners extending axially through less than all of said forming discs on said mandrel and directly attaching each of said forming discs to an adjacent forming disc so that each of said forming discs is positively fixed for rotation with an adjacent forming disc and said forming discs cooperatively define a rigid structure which defines said forming surface.

2. A forming roller according to claim 1, wherein each of said forming discs has a number of openings extending axially therethrough, said opening being irregular in shape and located in an irregular pattern.

3. A forming roller according to claim 2, further comprising a sound-deadening material in at least one of said openings.

4. A forming roller according to claim 3, wherein said sound-deadening material comprises a soft metal material.

5. A forming roller according to claim 4, wherein said soft metal material is selected from a class comprising brass, aluminum and lead.

6. A forming roller according to claim 3, wherein said sound-deadening material comprises a plastic or composition material.

7. A forming roller according to claim 1, wherein at least one pair of adjacent forming discs has a sound-deadening spacer disc disposed therebetween.

8. A forming roller according to claim 7, wherein said sound-deadening spacer disc comprises a soft metal material.

9. A forming roller according to claim 8, wherein said soft metal material is selected from a class comprising brass, aluminum and lead.

10. A forming roller according to claim 7, wherein said sound-deadening spacer disc comprises a plastic or composition material.

11. A forming roller according to claim 7, wherein said sound-deadening spacer disc has a compressed thickness of approximately 0.002 inches to approximately 0.050 inches.

12. A forming roller according to claim 1, wherein at least one pair of adjacent forming discs has a sound-deadening spacer disc disposed therebetween, said spacer disc having an outer diameter less than that of said forming discs, said sound-deadening spacer disc being contained within a recessed portion of the face of at least one of said adjacent forming discs such that a portion of said one adjacent forming disc is flush-mounted in a face-to-face relationship with a portion of the other of said forming disc.

13. A forming roller according to claim 12, wherein said sound-deadening spacer disc comprises a soft metal material.

14. A forming roller according to claim 13, wherein said soft metal material is selected from a class comprising brass, aluminum and lead.

15. A forming roller according to claim 12, wherein said sound-deadening spacer disc comprises a plastic or composition material.

16. A forming roller according to claim 12, wherein said sound-deadening spacer disc has a compressed thickness of approximately 0.002 inches to approximately 0.050 inches.

17. A forming roller according to claim 1, wherein at least one of said fasteners extends through only two adjacent forming discs to compressingly secure said adjacent forming discs to one another.

18. A forming roller according to claim 1, wherein at least one of said fasteners extends through a group of more than two of said forming discs, another of said fasteners extending through forming discs in more than one of said groups.

19. A forming roller according to claim 1, wherein said forming discs include circumferentially-undulating flutes on their peripheral surfaces, said flutes being aligned from disc to disc on said forming surface of said mandrel.

20. A forming roller according to claim 1, further comprising a coating of sound-deadening material on said mandrel between said mandrel and said forming discs.

21. A forming roller according to claim 1, further comprising a number of intermediate discs at longitudinally-spaced locations along said roller, said forming discs and said intermediate discs having aligned openings extending axially therethrough to form at least one conduit therethrough, said intermediate discs including radially-extending passages therein, said conduit being in communication with the forming surface of said roller through said radially-extending passages, and stationary vacuum manifold means slidably contacting an end of said rotatable forming roller for creating a vacuum in said conduit and in said radially-extending passages, thereby imposing a vacuum upon at least a portion of said forming surface in order to substantially retain sheet material in contact with said forming surface.

22. A forming roller according to claim 21, further comprising internal heating means in said mandrel for heating said forming surface.

23. A forming roller according to claim 1, wherein said forming discs are pre-formed with a number of different outside diameters and are mounted on said mandrel so that the outside diameter of said forming discs is greatest at a location approximately midway between the ends of said mandrel in order to form a crowned forming surface thereon.

24. A forming roller according to claim 1, wherein:

said mandrel includes a duct passing axially therethrough, said duct being adapted for connection to an external vacuum source, said mandrel further including at least one radially-extending passageway in vacuum communication with the peripheral surface of said mandrel; and at least one forming disc including manifold means in vacuum communication with said radially-extending passageway in said mandrel, said forming disc further including at least one radially-extending conduit in vacuum communication with said manifold means and a circumferentially-extending slot at its outer surface in vacuum communication with said radially-extending conduit, said external vacuum source thereby being adapted for imposing a vacuum upon at least a portion of said forming surface in order to substantially retain sheet material in contact with said forming surface.

25. A forming roller according to claim 1, wherein the axial thickness of said forming discs ranges from approximately one sixteenth of an inch to approximately one and one half inches and the outer diameter of said forming discs ranges from approximately eight inches to approximately fifteen inches.

26. A forming roller for a corrugating machine, comprising:

a rotatable mandrel;

a plurality of discrete forming discs axially mounted on said mandrel for rotation therewith, said forming discs having an axial thickness substantially less than their outside diameter so as to form a number of face-to-face joints between particular pairs of adjacent forming discs to facilitate frictional damping between such pairs of adjacent forming discs and cooperating to define a forming surface on said mandrel, said forming discs being hardened with circumferentially-undulating flutes on their peripheral surfaces prior to being mounted on said mandrel; and means for compressingly and rigidly securing said forming discs to one another on said mandrel, said securing means including a number of fasteners extending axially through less than all of said forming discs on said mandrel and directly each of said forming discs to an adjacent forming disc so that each of said forming discs is positively fixed for rotation with an adjacent forming disc and said forming discs cooperatively define a rigid structure which defines said forming surface.

27. A forming roller according to claim 26, wherein at least one of said fasteners extends through only two adjacent forming discs to compressingly secure said adjacent forming discs to one another.

28. A forming roller according to claim 26, wherein at least one of said fasteners extends through a group of more than two of said forming discs, another of said fasteners extending through forming discs in more than one of said groups.

29. A forming roller according to claim 28, wherein at least one pair of adjacent forming discs has a sound-deadening spacer disc disposed therebetween, said spacer disc having an outer diameter less than that of said forming discs, said sound-deadening spacer disc being contained within a recessed portion of the face of at least one of said adjacent forming discs such that a portion of said one adjacent forming disc is flush-mounted in a face-to-face relationship with a portion of the other of said forming disc.

30. A forming roller according to claim 28, further comprising a number of intermediate discs at longitudinally-spaced locations along said roller, said forming discs and said intermediate discs having aligned openings extending therethrough to form at least one conduit therethrough, said intermediate discs including radially-extending passages therein, said conduit being in communication with the forming surface of said roller through said radially-extending passages, and stationary vacuum manifold means slidably contacting an end of said rotatable forming roller for creating a vacuum in said conduit and in said radially-extending passages, thereby imposing a vacuum upon at least a portion of said forming surface in order to substantially retain sheet material in contact with said forming surface.

31. A forming roller according to claim 30, further comprising internal heating means in said mandrel for heating said forming surface.

32. A forming roller according to claim 31, wherein said internal heating means comprises a duct passing axially through said mandrel, said duct being adapted for connection to a source of a heating fluid in order to pass said heating fluid therethrough.

33. A forming roller according to claim 28, wherein said forming discs are pre-formed with different outside diameters and are mounted on said mandrel so that the outside diameter of said forming discs is greatest at a location approximately midway between the ends of said mandrel in order to form a crowned forming surface thereon.

34. A forming roller according to claim 28, wherein:

said mandrel includes a duct passing axially therethrough, said duct being adapted for connection to an external vacuum source, said mandrel further including at least one radially-extending passageway in vacuum communication with the peripheral surface of said mandrel; and at least one forming disc including manifold means in vacuum communication with said radially-extending passageway in said mandrel, said forming disc further including at least one radially-extending conduit in vacuum communication with said manifold means and a circumferentially-extending slot at its outer surface in vacuum communication with said radially-extending conduit, said external vacuum source thereby being adapted for imposing a vacuum upon at least a portion of said forming surface in order to substantially retain material to be formed in contact with said forming surface.

35. A forming roller according to claim 28, further comprising a coating of sound-deadening material on said mandrel between said mandrel and said forming discs.

36. A forming roller according to claim 28, wherein each of said forming discs has a number of openings extending axially therethrough, said openings being irregular in shape and located in an irregular pattern in order to provide varying resonant frequencies.

37. A forming roller according to claim 28, further comprising a sound-deadening material in at least one of said openings.

38. A forming roller according to claim 28, wherein at least one pair of adjacent forming discs has a sound-deadening spacer disc disposed therebetween.

39. A forming roller according to claim 26, wherein the axial thickness of said forming discs ranges from approximately one sixteenth of an inch to approximately one and one half inches and the outside diameter of said forming discs ranges from approximately eight inches to approximately fifteen inches.

40. A forming roller for a corrugating machine, comprising:

a rotatable mandrel;

a plurality of discrete forming discs supported at individual locations along the length of said mandrel for rotation therewith, with said forming discs having circumferentially-undulating flutes on their outer peripheral surfaces which cooperatively define a fluted forming surface on said forming roller and having respective axial dimensions which are substantially less than their respective outer diameters so that particular pairs of adjacent forming discs define radially extending opposed engagement surfaces which facilitate frictional damping between such pairs of adjacent forming discs, and with one or more of said forming discs having a number of irregularly shaped axial openings located in an irregular pattern about its engagement surfaces for varying the resonant frequency of said forming roller along its axial length;

a plurality of sound-deadening spacer discs, with each said spacer disc being disposed axially along said mandrel between a pair of adjacent forming discs; and means for compressingly and rigidly securing said forming discs to one another on said mandrel, said securing means including a series of threaded fasteners extending axially through less than all of said forming discs on said mandrel and directly attaching each of said forming discs to an adjacent forming disc so that each of said forming discs is positively fixed for rotation with an adjacent forming disc.

41. A forming roller according to claim 40, wherein each of said fasteners extends through only two adjacent forming discs.

42. A forming roller according to claim 40, wherein the axial dimension of said forming discs ranges from approximately one sixteenth of an inch to approximately one and one half inches, the outer diameter of said forming discs ranges from approximately eight inches to approximately fifteen inches, and each said sound-deadening spacer disc has a compressed thickness of approximately 0.002 inches to approximately 0.050 inches.

43. A forming roller according to claim 40, further comprising a coating of sound-deadening material on said mandrel between said mandrel and said forming discs, and a sound-deadening material in one or more of said irregularly shaped openings.

* * * * *

UNITED STATES PATENT AND TRADEMARK OFFICE

CERTIFICATE OF CORRECTION

PATENT NO. : 4,542,566

DATED : 9-24-85

INVENTOR(S) : Robert J. Sukenik

It is certified that error appears in the above-identified patent and that said Letters Patent is hereby corrected as shown below:

On page 2 of patent document References Cited, U.S. Patent Documents: "4,099,811" should be —4,099,311—

Col. 1, line 51 Delete "the" after "to"

Col. 7, line 23, Claim 26 insert —attaching— after "directly"

Signed and Sealed this

*Fourth* Day of *February 1986*

[SEAL]

*Attest:*

DONALD J. QUIGG

*Attesting Officer*

*Commissioner of Patents and Trademarks*